US009751344B2

(12) United States Patent
Takahashi et al.

(10) Patent No.: US 9,751,344 B2
(45) Date of Patent: Sep. 5, 2017

(54) PRINTING APPARATUS

(71) Applicant: SEIKO EPSON CORPORATION, Tokyo (JP)

(72) Inventors: Yoji Takahashi, Matsumoto (JP); Hiroshi Yoshida, Shiojiri (JP); Keishi Sawada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/292,410

(22) Filed: Oct. 13, 2016

(65) Prior Publication Data

US 2017/0106676 A1 Apr. 20, 2017

(30) Foreign Application Priority Data

Oct. 16, 2015 (JP) ..... 2015-204853

(51) Int. Cl.
*B41J 13/00* (2006.01)
*B41J 13/076* (2006.01)

(52) U.S. Cl.
CPC ..... *B41J 13/0009* (2013.01); *B41J 13/076* (2013.01)

(58) Field of Classification Search
CPC .... B41J 13/0009; B41J 11/003; B41J 13/076; B41J 17/02
See application file for complete search history.

(56) References Cited

U.S. PATENT DOCUMENTS

2008/0193184 A1* 8/2008 Daisuke ..... B41J 2/325 400/120.01
2014/0239113 A1 8/2014 Igarashi et al.
2016/0207333 A1 7/2016 Igarashi et al.

FOREIGN PATENT DOCUMENTS

JP 2014-165987 A 9/2014

* cited by examiner

*Primary Examiner* — Thinh H Nguyen
(74) *Attorney, Agent, or Firm* — Workman Nydegger

(57) ABSTRACT

A printing apparatus includes a feeding unit which includes a medium support unit which supports a roll-shaped medium, a feeding motor which rotates the medium support unit, and a transmission unit which transmits a driving force of the feeding motor to the medium support unit; a transport unit which transports a medium fed from the feeding unit; and a control unit which adjusts a tensile force of the medium between the medium support unit and the transport unit, by controlling the feeding motor, in which the transmission unit includes a plurality of transmission mechanisms, and the plurality of transmission mechanisms include a belt transmission mechanism which transmits the driving force using a belt.

6 Claims, 9 Drawing Sheets

PRINTING APPARATUS

BACKGROUND

1. Technical Field

The present invention relates to a printing apparatus provided with a feeding unit which feeds, for example, a roll-shaped medium to a transport unit.

2. Related Art

In the related art, a printing apparatus provided with a feeding unit which feeds a roll-shaped medium to a transport unit has been known. A feeding unit of a printing apparatus in JP-A-2014-165987 is provided with a transmission unit which transmits a driving force of a driving unit to a medium support unit which supports a roll-shaped medium. The transmission unit is provided with a transmission mechanism of a driving force which is formed when two toothed gears are engaged with each other. A driving force of a driving unit is decelerated in accordance with the number of teeth of the toothed gears which are engaged with each other, and feeds a medium to a transport unit by rotating the medium support unit thereafter. A control unit of the printing apparatus adjusts a tensile force of the medium between the medium support unit and the transport unit by controlling the driving unit, in order to properly perform printing on the medium.

In the transmission unit including the transmission mechanism which is formed of a toothed gear, vibration occurs due to backlash of the toothed gear, and a medium vibrates through the medium support unit. For this reason, there is a concern that a tensile force of a medium may fluctuate, and printing may not be properly performed on the medium.

SUMMARY

An advantage of some aspects of the invention is that a printing apparatus in which it is possible to reduce a fluctuation in a tensile force of a medium is provided.

Hereinafter, means of the invention and operation effects thereof will be described.

According to an aspect of the invention, there is provided a printing apparatus including a feeding unit which includes a medium support unit which supports a roll-shaped medium, a driving unit which rotates the medium support unit, and a transmission unit which transmits a driving force of the driving unit to the medium support unit; a transport unit which transports a medium fed from the feeding unit; and a control unit which adjusts a tensile force of the medium between the medium support unit and the transport unit, by controlling the driving unit, in which the transmission unit includes a plurality of transmission mechanisms, and the plurality of transmission mechanisms include a belt transmission mechanism which transmits the driving force using a belt.

According to the configuration, since the belt transmission mechanism which is included in the transmission unit does not cause backlash, there is a small vibration of a medium which is caused by the transmission unit, compared to a case in which all of the transmission mechanisms included in the transmission unit are formed of a toothed gear. For this reason, it is possible to reduce a fluctuation in a tensile force of the medium.

In the printing apparatus, the transmission mechanism that is most downstream among the plurality of transmission mechanisms on a transmission path of the driving force may be the belt transmission mechanism.

According to the configuration, since the transmission mechanism that is most downstream which is close to the medium support unit, and easily causes the medium to vibrate is the belt transmission mechanism, it is possible to reduce vibration of the medium, compared to a case in which the transmission mechanism that is most downstream is formed of a toothed gear.

In the printing apparatus, the transmission mechanism with the highest moderation ratio among the plurality of transmission mechanisms may be the belt transmission mechanism.

Among the transmission mechanisms, the transmission mechanism with a high moderation ratio which transmits a driving force using a toothed gear has a tendency to easily cause a large backlash. According to the configuration, since the transmission mechanism with the highest moderation ratio is the belt transmission mechanism, it is possible to reduce vibration of a medium, compared to a case in which the transmission mechanism with the highest moderation ratio is formed of a toothed gear.

In the printing apparatus, the plurality of transmission mechanisms may include a toothed gear transmission mechanism which transmits a driving force using a toothed gear.

In the belt transmission mechanism, there is a tendency for the transmission mechanism to become large. According to the configuration, since at least one of the plurality of transmission mechanisms other than the belt transmission mechanism is the toothed gear transmission mechanism, it can contribute to size reduction of the printing apparatus.

In the printing apparatus, the feeding unit may include a tensile force adjusting mechanism for adjusting a tensile force of the belt.

According to the configuration, since a tensile force of the belt is adjusted, by using the tensile force adjusting mechanism, it is possible to easily adjust a tensile force of the belt in each printing apparatus, even after assembling the printing apparatus.

In the printing apparatus, the belt transmission mechanism may include a first pulley and a second pulley around which the belt is wound, the first pulley may be disposed on an upstream side of the second pulley on a transmission path of the driving force, and the tensile force adjusting mechanism may be provided with an upstream side support unit which supports the driving unit and the first pulley, and a movement mechanism for moving the upstream side support unit with respect to the second pulley.

According to the configuration, since it is possible to integrally move the driving unit and the first pulley using the movement mechanism, it is possible to easily adjust a tensile force of the belt, compared to a case in which a tensile force of the belt is adjusted by separately moving the driving unit and the first pulley.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of a printing apparatus will be described with reference to the drawings. The printing apparatus is an apparatus which holds a roll-shaped medium which has been wound in a roll shape, and can unwind the roll-shaped medium which has been wound, by rotating the roll-shaped medium. The printing apparatus is a large-format printer which performs printing on an unwound medium.

Figure 1:
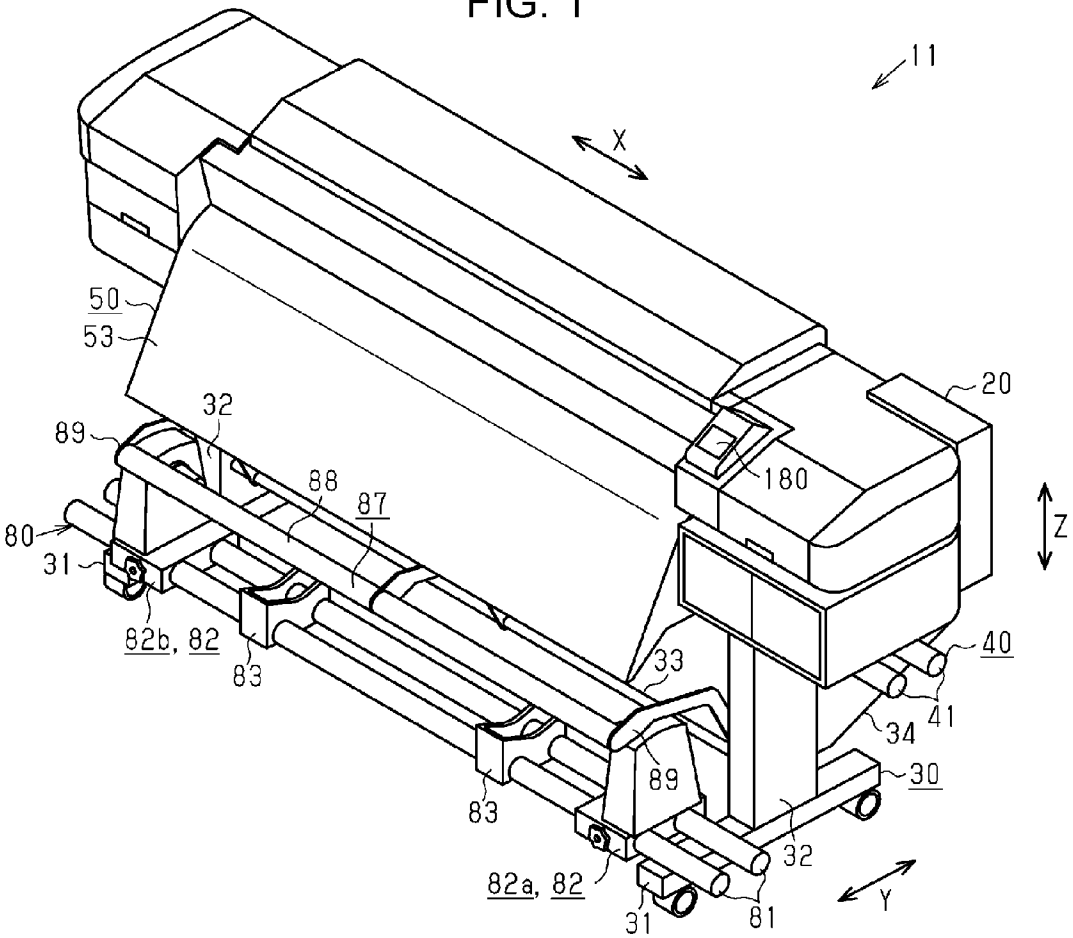
FIG. 1 is a perspective view of a printing apparatus.
Figure 2:
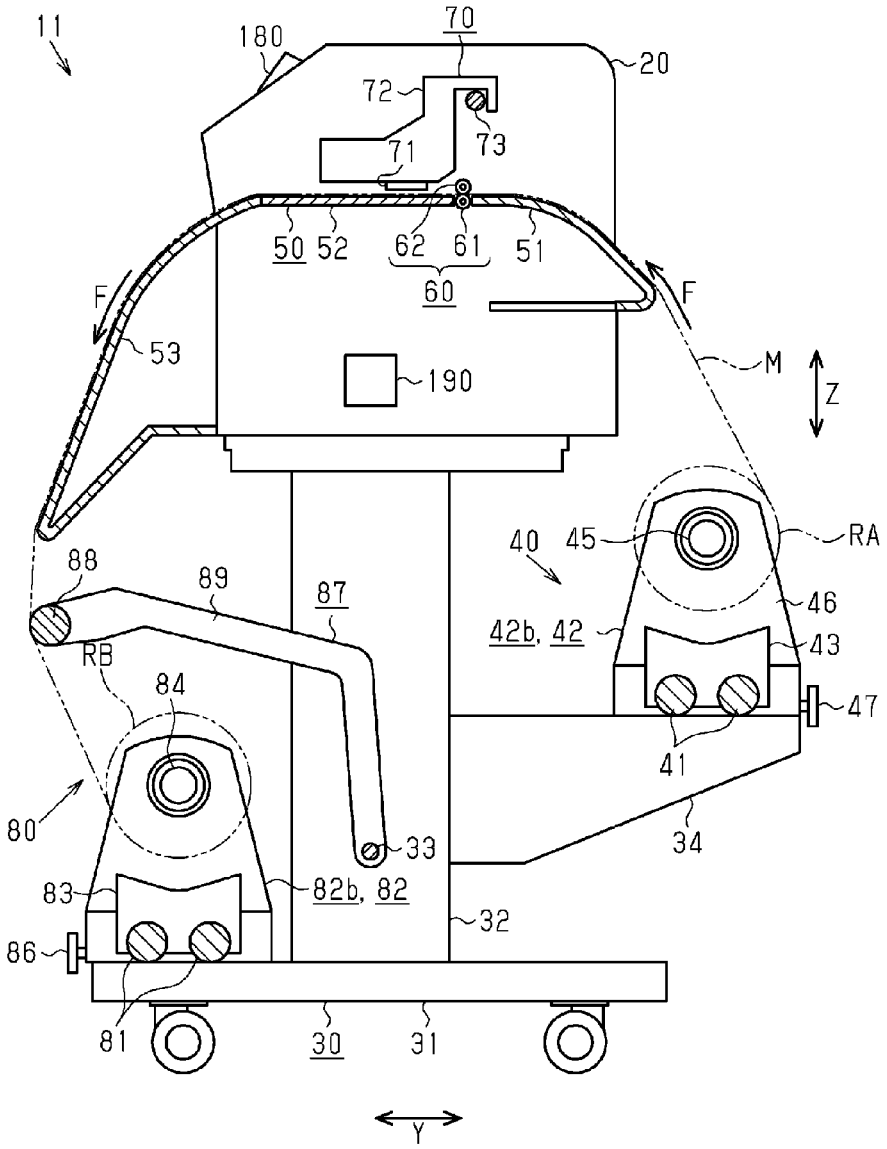
FIG. 2 is a side sectional view which illustrates a schematic configuration of the printing apparatus.

As illustrated in FIG. 1, a printing apparatus 11 is provided with a housing 20 that is box-shaped, and a housing support unit 30 which supports the housing 20. As illustrated in FIG. 2, the printing apparatus 11 is further provided with a feeding unit 40 which feeds a medium M which has been wound in a roll shape along a transport direction of the medium M, a support unit 50 which supports the medium M, a transport unit 60 which transports the medium M, a printing unit 70 which performs printing on the medium M, and a winding unit 80 which winds up the medium M in a roll shape. In addition, the printing apparatus 11 is provided with an operation unit 180 which is operated by a user, and a control unit 190 which generally controls the apparatus.

In the following descriptions, a medium M which has been wound in a roll shape and is supported by the feeding unit 40 is a roll-shaped medium RA. In addition, a medium M which is wound by the winding unit 80, and is formed in a roll shape is a roll-shaped medium RB. The roll-shaped mediums RA and RB are formed by winding the medium M around a cylindrical core material (not illustrated). The core material is not necessarily a separate body from the medium M, and for example, may be a core material formed by winding the medium M in a cylindrical shape and hardening the medium M on the inner peripheral side using an adhesive or the like.

In addition, a width direction of the printing apparatus 11 is a "width direction X", an anteroposterior direction of the printing apparatus 11 is an "anteroposterior direction Y", a vertical direction of the printing apparatus 11 is a "vertical direction Z", and a transport direction of the medium M is a "transport direction F". Here, the width direction X, the anteroposterior direction Y, and the vertical direction Z are directions which intersect (orthogonal) each other, and the width direction X is a direction which intersects (orthogonal) the transport direction F.

As illustrated in FIGS. 1 and 2, the housing support unit 30 includes a first leg portion 31 having the anteroposterior direction Y as the longitudinal direction thereof, a second leg portion 32 which extends to the upper side from the first leg portion 31, a connecting shaft 33 which is connected to the second leg portion 32 in the width direction X, and an extending portion 34 which extends to the rear side from the second leg portion 32. The first leg portion 31 and the second leg portion 32 are provided so as to form a pair in the width direction X. In addition, an upper end portion of the second leg portion 32 on a side opposite to a lower end portion which is connected to the first leg portion 31 is connected to the housing 20.

Figure 3:
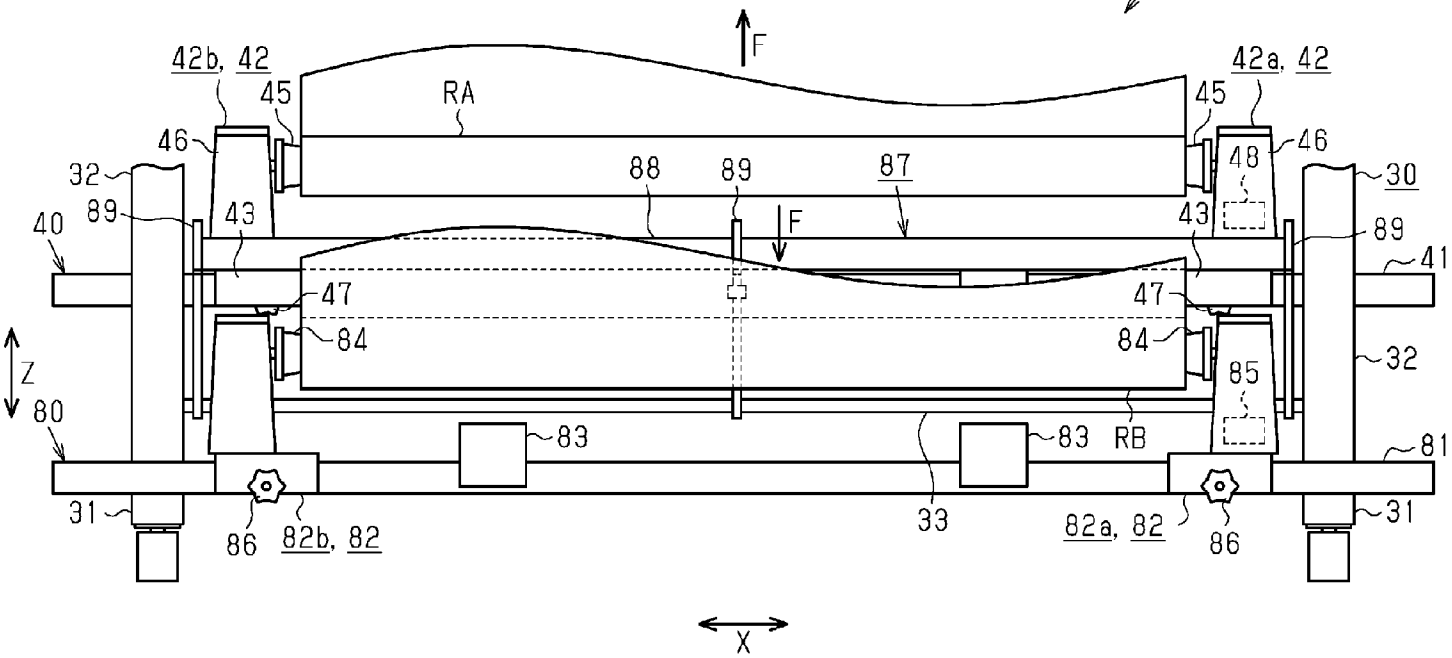
FIG. 3 is a plan view of main portions of the printing apparatus.

The feeding unit 40 is supported by the extending portion 34 of the housing support unit 30 on the rear-lower side of the housing 20. As illustrated in FIGS. 2 and 3, the feeding unit 40 is provided with guide shafts 41 which are mounted on the extending portion 34 so as to have the width direction X as the longitudinal direction of the guide shafts 41, and a feeding section 42 which holds the roll-shaped medium RA so as to rotate. The guide shafts 41 are provided as a pair in the anteroposterior direction Y.

As illustrated in FIG. 3, the feeding section 42 includes a first feeding section 42*a* which is provided at one end portion of the guide shafts 41 in the width direction X, and a second feeding section 42*b* which is provided at the other end portion. The feeding sections 42*a* and 42*b* are supported so as to slide with respect to the guide shafts 41.

Figure 4:
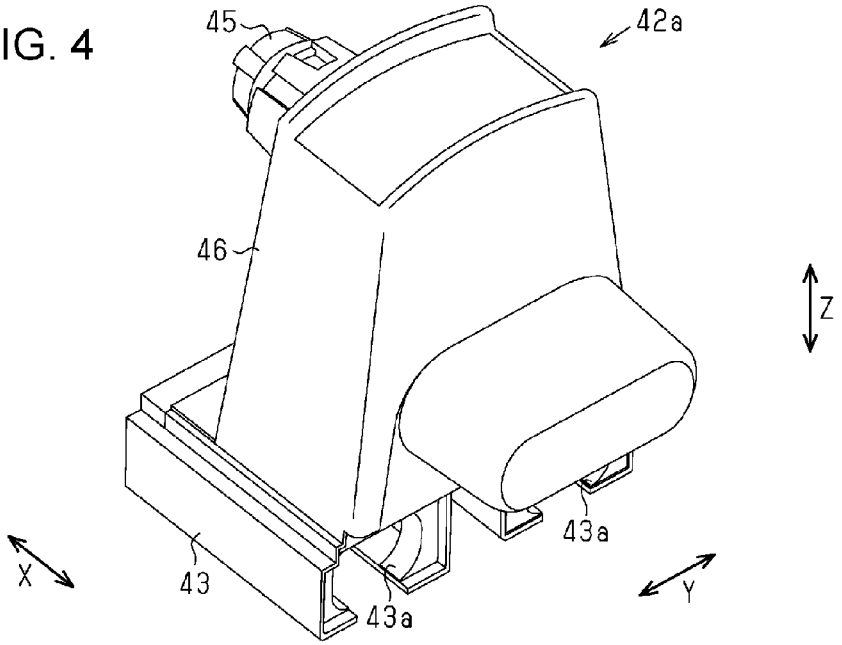
FIG. 4 is a perspective view of a first feeding unit.
Figure 5:
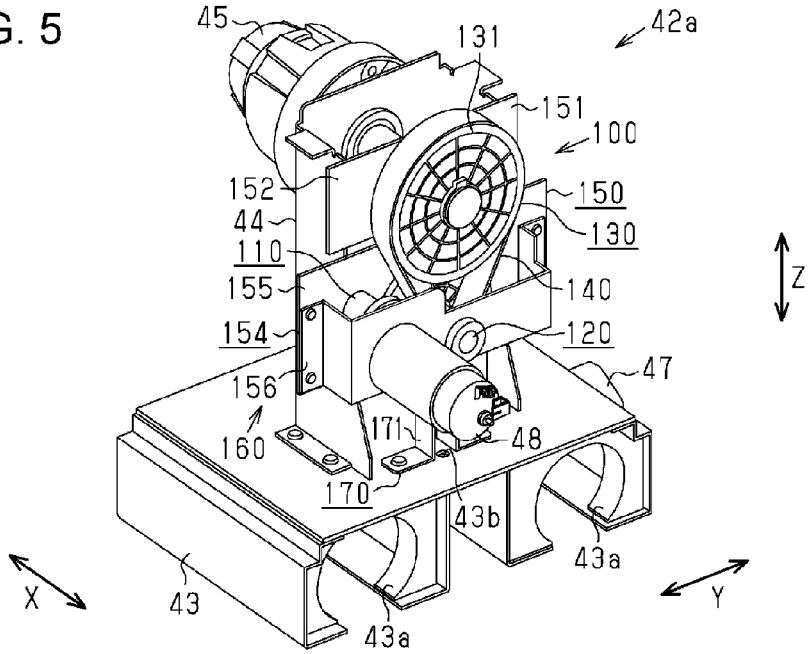
FIG. 5 is a perspective view of the first feeding unit in a state in which a housing is detached.

As illustrated in FIG. 5, the first feeding section 42*a* includes a mounting unit 43 which includes attaching portions 43*a* which are fitted to the guide shafts 41 (refer to FIG. 3), a standing portion 44 which stands upward in the vertical direction Z from the mounting unit 43, and a medium support unit 45 which protrudes from the standing portion 44 toward the inside in the width direction X. As illustrated in FIGS. 4 and 5, the feeding section 42*a* is further provided with a housing 46 which covers the standing portion 44, and a lockscrew 47 which permits or limits a movement of the first feeding section 42*a* in the width direction X with respect to the guide shaft 41 (refer to FIG. 3). In addition, as illustrated in FIG. 3, also the second feeding section 42*b* includes the mounting unit 43, the medium support unit 45, the housing 46, and the lockscrew 47 that are the same as those in the first feeding section 42*a*. In addition, though it is not illustrated, the standing portion 44 is accommodated inside the housing 46 of the second feeding section 42*b*. The first feeding section 42*a* and the second feeding section 42*b* are mounted on the guide shafts 41 so that the medium support units 45 face each other.

The medium support units 45 integrally rotate with the roll-shaped medium RA when inserted into the core material (for example, paper tube) of the roll-shaped medium RA. For this reason, the medium support units 45 are formed in an approximately truncated cone shape so as to taper off toward a tip end from a base end. The medium support units 45 of the two feeding sections 42*a* and 42*b* engage with both ends of the roll-shaped medium RA, respectively. In addition, the feeding unit 40 feeds a medium M which is wound around as one roll-shaped medium RA, by rotating the roll-shaped medium RA.

As illustrated in FIG. 5, the first feeding section 42*a* is provided with a feeding motor 48 which is supported by the standing portion 44 in the inside of the housing 46, and rotates the medium support units 45, a transmission unit 100 which transmits a driving force of the feeding motor 48 to the medium support unit 45, and an attaching portion 150 which attaches the feeding motor 48 and the transmission unit 100 to the standing portion 44. In this point, according to the embodiment, the feeding motor 48 corresponds to an example of a "driving unit which rotates the medium support units".

The attaching portion 150 includes a downstream side support unit 151 which supports the downstream side of the transmission unit 100 on the transmission path of a driving force of the transmission unit 100, and an upstream side support unit 154 which supports the upstream side of the transmission unit 100 on the transmission path of a driving force of the transmission unit 100. The downstream side support unit 151 is provided with a first support plate 152 which extends in a direction orthogonal to the width direction X, and a second support plate 153 (refer to FIG. 8) which extends in a direction orthogonal to the width direction X, and is disposed on the mounting unit 43 side, compared to the first support plate 152. The first support plate 152 and the second support plate 153 are attached to the standing portion 44 so as not to move.

Figure 7:
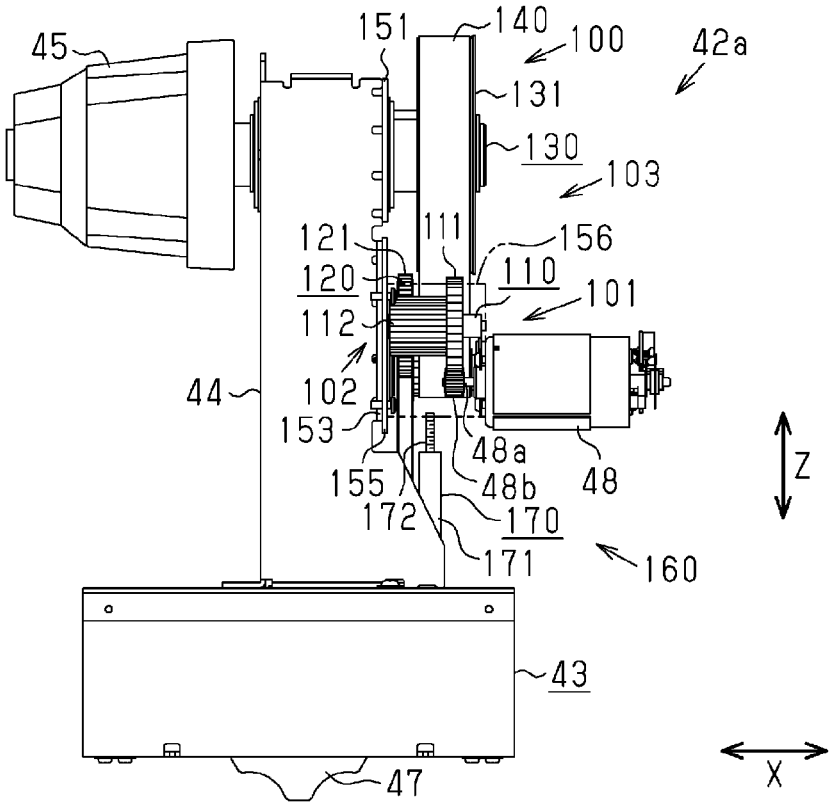
FIG. 7 is a side view of the first feeding unit in a state in which the housing is detached.

As illustrated in FIGS. 5 and 7, the upstream side support unit 154 is provided with a rear face support plate 155 which extends in a direction orthogonal to the width direction X, and a motor support plate 156 which extends in the direction orthogonal to the width direction X, and is disposed on the outer side of the rear face support plate 155 in the width direction X. The rear face support plate 155 and the motor support plate 156 are attached to the standing portion 44 so as to be parallel in the width direction X. Both end portions of the motor support plate 156 in the anteroposterior direction Y are subjected to bending machining toward the rear face support plate 155, and are fixed to the rear face support plate 155.

Figure 8:
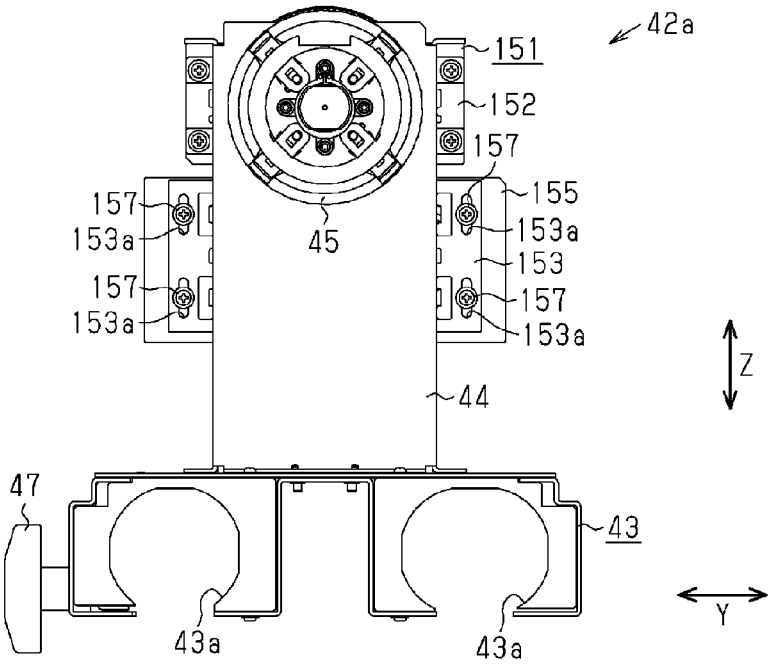
FIG. 8 is a rear view of the first feeding unit in a state in which the housing is detached.

As illustrated in FIG. 8, the rear face support plate 155 is attached to the second support plate 153. Specifically, the rear face support plate 155 is attached to the second support plate 153 when screws 157 are screwed into long holes 153*a* which is formed in the second support plate 153 so as to extend in the vertical direction Z and a hole (not illustrated) which is formed in the rear face support plate 155.

Figure 6:
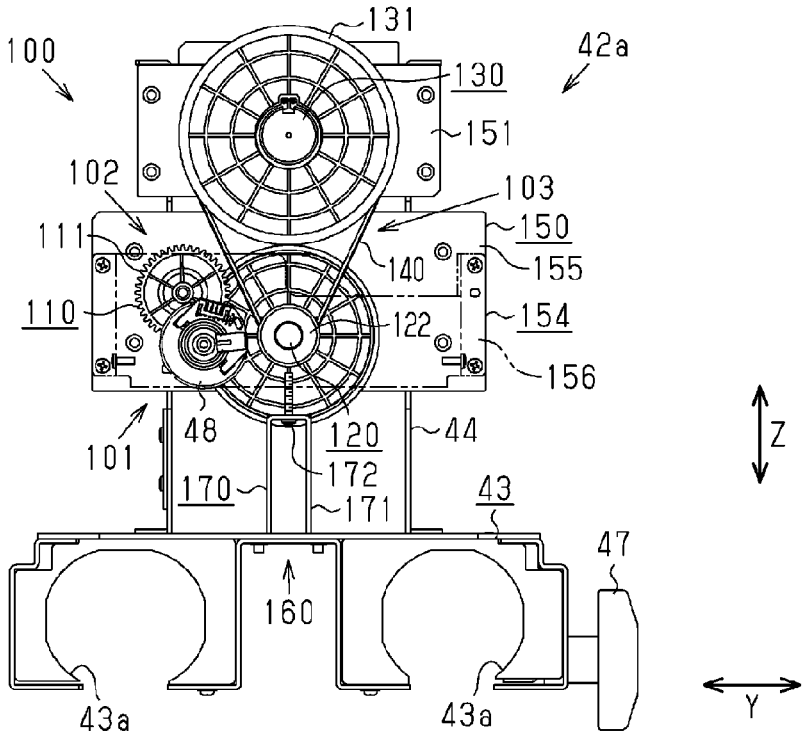
FIG. 6 is a front view of the first feeding unit in a state in which the housing is detached.

As illustrated in FIGS. 6 and 7, the transmission unit 100 is provided with a first transmission mechanism 101 which transmits a rotation of an output shaft 48*a* of the feeding motor 48 by deceleration thereof, a second transmission mechanism 102 which transmits a rotation of the first transmission mechanism 101 by deceleration thereof, and a third transmission mechanism 103 which transmits a rotation of the second transmission mechanism 102 to a first rotating body 110 by deceleration thereof. That is, the transmission unit 100 includes a plurality of the transmission mechanisms 101, 102, and 103.

Specifically, the transmission unit 100 is provided with the output shaft 48*a* of the feeding motor 48 which is rotatably supported by the motor support plate 156, the first rotating body 110 and a second rotating body 120 which are rotatably supported by the motor support plate 156 and the rear face support plate 155, a third rotating body 130 which is rotatably supported by the downstream side support unit 151, and a belt 140.

A toothed gear 48*b* which engages with a toothed gear 111 which is formed on the outer periphery of the first rotating body 110 is formed on the outer periphery of the output shaft 48*a* of the feeding motor 48. The toothed gear 48*b* of the output shaft 48*a* of the feeding motor 48, and the toothed gear 111 of the first rotating body 110 form the first transmission mechanism 101. That is, in the first transmission mechanism 101 which is one of the plurality of the transmission mechanisms 101, 102, and 103, a driving force is transmitted using the toothed gears 48*b* and 111. In this point, according to the embodiment, the first transmission mechanism 101 corresponds to an example of the "toothed gear transmission mechanism". The number of teeth of the toothed gear 111 is larger than the number of teeth of the toothed gear 48*b*. For this reason, the first transmission mechanism 101 decelerates a rotation of the feeding motor 48, and transmits the rotation to the first rotating body 110.

A toothed gear 112 engaged with a toothed gear 121 which is formed at the outer periphery of the second rotating body 120 is formed at a portion different from the toothed gear 111 of the first rotating body 110. The toothed gear 112 of the first rotating body 110 and the toothed gear 121 of the second rotating body 120 form the second transmission mechanism 102. That is, a driving force of the second transmission mechanism 102 which is one of the plurality of the transmission mechanisms 101, 102, and 103 is transmitted using the toothed gears 112 and 121. In this point, according to the embodiment, the second transmission mechanism 102 corresponds to an example of the "toothed gear transmission mechanism". The number of teeth of the toothed gear 121 is larger than the number of teeth of the toothed gear 112. For this reason, the second transmission mechanism 102 decelerates a rotation of the first rotating body 110, and transmits the rotation to the second rotating body 120. A difference in the number of teeth between the toothed gear 121 and the toothed gear 112 is larger than a difference in the number of teeth between the toothed gear 111 and the toothed gear 48*b*. For this reason, a moderation ratio of the second transmission mechanism 102 is larger than that of the first transmission mechanism 101.

A first pulley 122 is provided at a portion of the second rotating body 120 which is different from the toothed gear 121. In addition, a second pulley 131 is provided in the third rotating body 130 which rotates integrally with the medium support unit 45 of the feeding unit 40. External teeth are formed in the first pulley 122 and the second pulley 131. A belt 140 that is toothed is wound around the first pulley 122 and the second pulley 131, and a rotation of the second rotating body 120 is transmitted to the third rotating body 130. The first pulley 122, the second pulley 131, and the belt 140 form the third transmission mechanism 103. That is, a driving force of the third transmission mechanism 103 which is one of the plurality of the transmission mechanisms 101, 102, and 103 is transmitted using the belt 140. In this point, according to the embodiment, the third transmission mechanism 103 corresponds to an example of the "belt transmission mechanism". An outer diameter of the second pulley 131 is larger than an outer diameter of the first pulley 122. For this reason, the third transmission mechanism 103 decelerates a rotation of the second rotating body 120, and transmits the rotation to the third rotating body 130. A moderation ratio of the third transmission mechanism 103 is larger than those of the first transmission mechanism 101 and the second transmission mechanism 102. That is, the third transmission mechanism 103 with the highest moderation ratio among the plurality of the transmission mechanisms 101, 102, and 103 is the belt transmission mechanism.

The medium support unit 45 is provided at an end portion of the third rotating body 130 on a side opposite to the second pulley 131 in the width direction X. For this reason, a driving force of the feeding motor 48 is transmitted from the feeding motor 48 on the upstream side to the medium support unit 45 on the downstream side through the first transmission mechanism 101, the second transmission mechanism 102, and the third transmission mechanism 103. That is, the transmission mechanism 103 that is most downstream on a transmission path of a driving force among the plurality of the transmission mechanisms 101, 102, and 103 is the belt transmission mechanism.

The first feeding section 42*a* is further provided with a tensile force adjusting mechanism 160 for adjusting a tensile force of the belt 140. The tensile force adjusting mechanism 160 is provided with the upstream side support unit 154, and a movement mechanism 170 for adjusting a position of the upstream side support unit 154 with respect to the downstream side support unit 151. The movement mechanism 170 is provided with a leg portion 171 which connects the mounting unit 43 and the motor support plate 156, and a screw 172. The leg portion 171 is formed in a U shape, and both end portions are attached to a top face of the mounting unit 43 on the motor support plate 156 side. The screw 172 is screwed to a U-shaped base portion of the leg portion 171 (upper side in FIG. 6) and the motor support plate 156 so that a head thereof faces downward.

Figure 9:
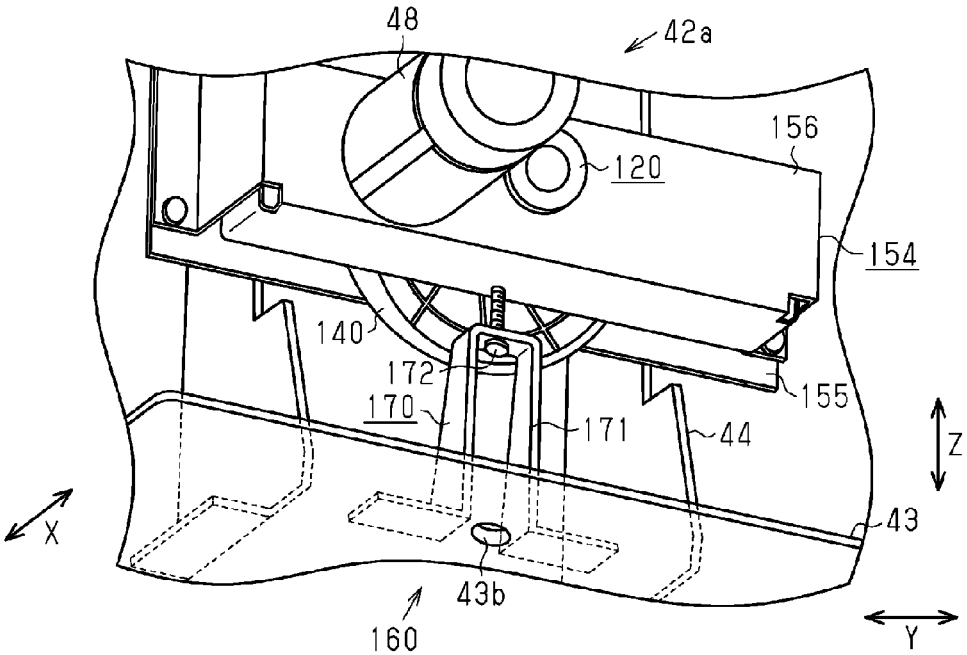
FIG. 9 is a perspective view of an adjusting unit of the first feeding unit.

As illustrated in FIG. 9, a hole 43*b* through which it is possible to turn the screw 172 with a driver (not illustrated) is formed in between the legs of the leg portion 171 of the mounting unit 43. The movement mechanism 170 can move the upstream side support unit 154 with respect to the second pulley 131 (refer to FIG. 6), by adjusting a screwing amount of the screw 172 with respect to the motor support plate 156.

An adjustment method for adjusting a tensile force of the belt 140 will be described with reference to FIGS. 8 and 9.

A user detaches the housing 46 (refer to FIG. 4), and exposes the inside of the first feeding section 42*a*. Subsequently, the user loosens or detaches all of the screws 157 which are engaged with the long holes 153*a*. Subsequently, the user inserts a driver (not illustrated) into the hole 43*b*, and adjusts a distance between the leg portion 171 and the motor support plate 156 by turning the screw 172. The feeding motor 48, the first rotating body 110, and the second rotating body 120 are supported by the motor support plate 156 and the rear face support plate 155 which is fixed to the motor support plate 156. For this reason, the feeding motor 48, the first rotating body 110, and the second rotating body 120 integrally move according to a change in the relative position between the leg portion 171 and the motor support plate 156 and the rear face support plate 155. For this reason, a tensile force of the belt 140 becomes large, when the screw 172 is turned in a direction in which the motor support plate 156 and the rear face support plate 155 separate from the leg portion 171. A tensile force of the belt 140 becomes small, when the screw 172 is turned in a direction in which the motor support plate 156 and the rear face support plate 155 approach the leg portion 171.

As illustrated in FIG. 2, the support unit 50 includes a first support unit 51 which is formed so as to face the housing 20 from the rear-lower side of the housing 20, a second support unit 52 which is formed so as to face the front side in the inside of the housing 20, and a third support unit 53 which is formed so as to face the front-lower side of the housing 20 from the housing 20. In this manner, the support unit 50 guides the medium M which is fed from the feeding unit 40 toward the winding unit 80, and supports the medium M. In addition, in a case where it is necessary to heat the medium M before and after printing according to a printing method of the printing apparatus 11, a heater for heating the medium M may be built inside the support unit 50.

The transport unit 60 is provided with a driving roller 61 which rotates while in contact with the rear face of the medium M, and a driven roller 62 which rotates while in contact with the front face of the medium M. In addition, the transport unit 60 performs a transport operation which transports the medium M which is fed from the feeding unit 40 toward the transport direction F by driving the driving roller 61 while the medium M is interposed between the driving roller 61 and the driven roller 62. When performing the transport operation, feeding of the medium M using the feeding unit 40 and winding of the medium M using the winding unit 80 are simultaneously performed.

The printing unit 70 is provided with an ejecting unit 71 which ejects ink, a carriage 72 which holds the ejecting unit 71, and a guide shaft 73 which supports the carriage 72 and which has the width direction X as a longitudinal direction thereof. In addition, the printing unit 70 performs a printing operation which forms characters or an image on the medium M by ejecting ink onto the medium M which is supported by the support unit 50 from the ejecting unit 71 while the carriage 72 moves in the scanning direction (width direction X).

As illustrated in FIGS. 1 and 2, the winding unit 80 is supported on the front side of the first leg portion 31 of the housing support unit 30. As illustrated in FIGS. 2 and 3, the winding unit 80 is provided with guide shafts 81 which are constructed in the first leg portion 31 and which have the width direction X as a longitudinal direction, a winding section 82 which rotatably holds the roll-shaped medium RB which is formed by winding around the medium M in a cylindrical shape, and mounting units 83 on which the roll-shaped medium RB is temporarily mounted when the roll-shaped medium RB is detached. The guide shafts 81 are provided as a pair in the anteroposterior direction Y, and the mounting units 83 are provided as a pair in the width direction X.

The winding section 82 includes two winding sections 82*a* and 82*b* which are respectively provided at both ends in the width direction X. The winding sections 82*a* and 82*b* are supported so as to slide with respect to the guide shaft 81. The winding sections 82*a* and 82*b* are respectively provided with medium support units 84 which can rotate integrally with the roll-shaped medium RB by engaging with an end portion of the roll-shaped medium RB in the width direction, and a lockscrew 86 which permits or limits a movement of the winding sections 82*a* and 82*b* in the width direction X with respect to the guide shaft 81. In addition, a winding motor 85 which rotatably drives the medium support units 84 is built in the winding section 82*a*.

The medium support units 84 of the winding sections 82*a* and 82*b* rotate integrally with the roll-shaped medium RB when inserted into an end portion of a core material (for example, paper tube) of the roll-shaped medium RB. For this reason, the medium support units 84 of the winding section 82 are formed in an approximately truncated cone shape so as to taper off toward a tip end from a base end.

The two winding sections 82*a* and 82*b* are installed in the guide shafts 81 so that the medium support units 84 face each other. The medium support units 84 of the two winding sections 82 engage with both ends of the roll-shaped medium RB. In addition, the winding unit 80 winds the medium M as the roll-shaped medium RB, by rotating the roll-shaped medium RB by driving the winding motor 85.

As illustrated in FIG. 1, the winding unit 80 is provided with tensile force applying mechanisms 87 which apply a tensile force to the medium M when winding the medium M as the roll-shaped medium RB. The tensile force applying mechanisms 87 are respectively provided at both end portions in the width direction X.

As illustrated in FIGS. 2 and 3, the tensile force applying mechanisms 87 are provided with a pressing portion 88 which is formed in a columnar shape and which has the width direction X as an axial direction thereof, and an arm member 89 which supports a tip end of the pressing portion 88, and form a pair. In addition, in the arm member 89, the connecting shaft 33 which connects the second leg portion 32 of the housing support unit 30 in the width direction X is inserted into a base end portion thereof.

In this manner, the tensile force applying mechanism 87 can oscillate with the connecting shaft 33 as a center of oscillation. Since the center of gravity of the tensile force applying mechanism 87 is located in front of the center of oscillation when applying a tensile force to the medium M, the tensile force applying mechanism has a tendency to fall toward the front-lower side with the connecting shaft 33 as the center of oscillation due to its own weight. In this manner, the tensile force applying mechanism 87 presses the medium M in the width direction X and a direction intersecting the transport direction F, and applies a tensile force to the medium M in the transport direction F.

In addition, since the medium M can have a tensile force applied thereto using the tensile force applying mechanism 87, the medium M can be transported without being loosened, even when feeding of the medium M using the feeding unit 40 and winding up of the medium M using the winding unit 80 are not synchronized when performing the transport operation.

As illustrated in FIGS. 1 and 2, the operation unit 180 is provided on a top face of the printing apparatus 11. The operation unit 180 is operated by a user in a case in which various settings of the printing apparatus 11 are performed, or a case in which performing of printing is supported with respect to the printing apparatus 11. For this reason, it is desirable that the operation unit 180 include a plurality of buttons, a liquid crystal display, or the like, for example.

The control unit 190 is a so-called microcomputer which includes a CPU, a ROM, a RAM, or the like. The control unit 190 performs printing on the medium M by causing a transport operation and an ejecting operation to be alternately performed by controlling driving of each configuration, based on a printing job which is input to the printing apparatus 11, for example.

In addition, according to the embodiment, when an outer diameter of the roll-shaped medium RA which is held in the feeding unit 40 becomes small due to continuous transporting of the medium M, the feeding amount of the medium M when causing the roll-shaped medium RA to perform one rotation becomes small. On the other hand, when the outer diameter of the roll-shaped medium RB which is held in the winding unit 80 becomes large due to continuous transporting of the medium M, the winding amount of the medium M when causing the roll-shaped medium RB to perform one rotation becomes large. Accordingly, the control unit 190 performs control so that the rotational speed of the feeding motor 48 of the feeding unit 40 is increased, and the rotational speed of the winding motor 85 of the winding unit 80 is decreased along with continuous transporting of the medium M. That is, the control unit 190 adjusts a tensile force of the medium M between the medium support unit 45 and the transport unit 60, by controlling the feeding motor 48. In addition, the feeding motor 48 is provided with a rotation angle sensor (not illustrated). The control unit 190 controls the rotational speed of the feeding motor 48 based on an output of the rotation angle sensor.

Subsequently, operations of the printing apparatus 11 which is formed as above will be described.

Figure 10:
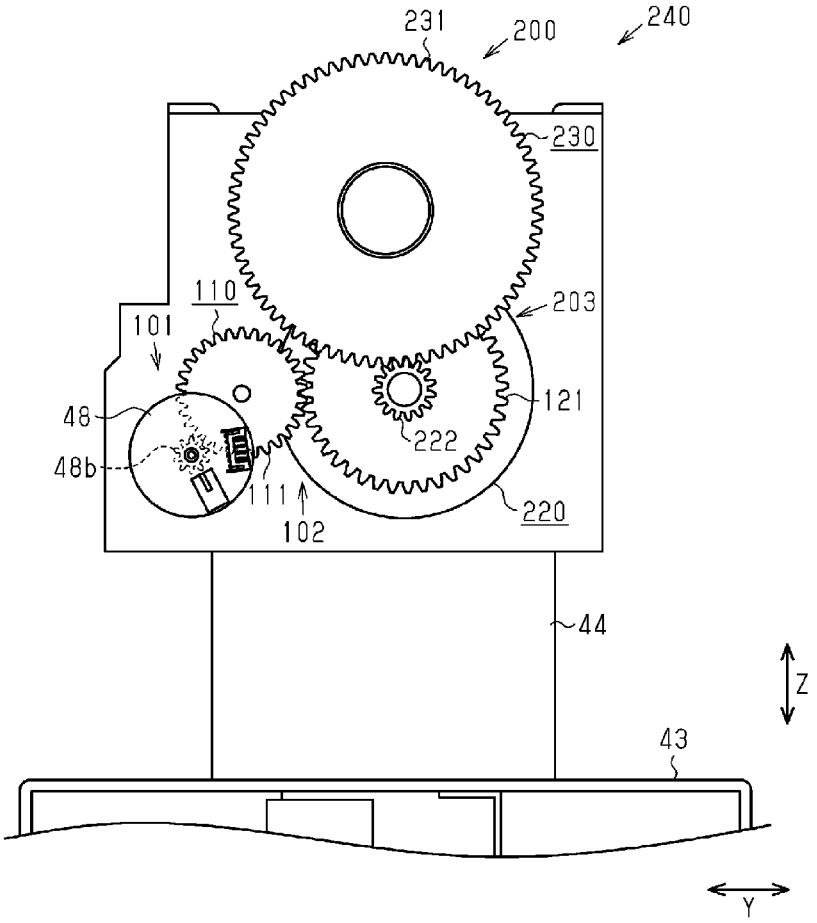
FIG. 10 is a front view of a first feeding unit in a comparison example.

FIG. 10 illustrates a feeding section 240 in a comparison example which includes a transmission unit 200.

The transmission unit 200 includes a third transmission mechanism 203 which transmits a driving force using a toothed gear. The third transmission mechanism 203 is formed when a toothed gear 222 which is formed on the outer periphery of a second rotating body 220 engages with a toothed gear 231 which is formed on the outer periphery of a third rotating body 230.

In the transmission unit 200, since all of the first transmission mechanism 101, the second transmission mechanism 102, and the third transmission mechanism 203 are formed as a toothed gear transmission mechanism, a driving force is transmitted to the medium support unit 45 by including backlash which occurs, respectively.

On the other hand, in the transmission unit 100 in the embodiment which is illustrated in FIG. 6, since the third transmission mechanism 103 is formed as the belt transmission mechanism, only backlash which occurs in the first transmission mechanism 101 and the second transmission mechanism 102 is transmitted to the medium support unit 45. Moreover, since the third transmission mechanism 103 is disposed most downstream on the transport path of a driving force, that is, on a side which is close to the medium support unit 45, it is possible to reduce an influence of backlash on the medium M, which occurs in the first transmission mechanism 101 and the second transmission mechanism 102.

In addition, the third transmission mechanism 203 in the comparison example which is illustrated in FIG. 10 has the highest moderation ratio among the plurality of the transmission mechanisms of 101, 102, and 203. For this reason, backlash of the third transmission mechanism 203 is larger than that of the first transmission mechanism 101 and the second transmission mechanism 102. According to the embodiment, since the third transmission mechanism 103 with the highest moderation ratio is formed as the belt transmission mechanism, it is possible to effectively reduce backlash of the entirety of the transmission unit 100.

According to the above described embodiment, it is possible to obtain the following effects.

(1) In the printing apparatus 11, since the third transmission mechanism 103 as the belt transmission mechanism is included in the transmission unit 100, vibration of the medium M is small, compared to a case in which the entire transmission mechanism included in the transmission unit 100 is formed of a toothed gear. For this reason, it is possible to reduce a fluctuation in tension of the medium M. In addition, it is possible to reduce undesirable noise which is caused by backlash. In a case in which a so-called backlashless gear in which backlash is reduced by causing engagement of a toothed gear as the transmission mechanism to deviate is used, there is a concern that the control performance for controlling a tensile force of the medium M may deteriorate due to a deviation of engagement of the toothed gear, and a concern that there may be a lot of undesirable noise. In the printing apparatus 11 according to the embodiment, since the transmission unit 100 is provided with the belt transmission mechanism, it is possible to prevent a control performance from being deteriorated, while reducing backlash.

(2) In the printing apparatus 11, since the third transmission mechanism 103 that is most downstream which is close to the medium support unit 45 and easily has an influence on the medium M is the belt transmission mechanism, it is possible to reduce a vibration of the medium M, compared to a case in which the transmission mechanism on most downstream side is formed of a toothed gear.

(3) In the printing apparatus 11, since the third transmission mechanism 103 with the highest moderation ratio is the belt transmission mechanism, it is possible to reduce vibration of a medium, compared to a case in which the transmission mechanism with the highest moderation ratio is formed of a toothed gear.

(4) In the printing apparatus 11, since at least one of the plurality of transmission mechanisms 101, 102, and 103 other than the third transmission mechanism 103 as the belt transmission mechanism is the toothed gear transmission mechanism, it contributes to size reduction of the printing apparatus 11. In addition, since it is possible to reduce the number of components in the toothed gear transmission mechanism, compared to the belt transmission mechanism, it contributes to a reduction in the number of components, compared to a case in which all of the plurality of transmission mechanisms 101, 102, and 103 of the transmission unit 100 may be the belt transmission mechanism.

(5) In the printing apparatus 11, since the feeding unit 40 includes the tensile force adjusting mechanism 160 which adjusts a tensile force of the belt 140, it is possible to easily adjust a tensile force of the belt 140 in each printing apparatus 11, even after assembling the printing apparatus 11.

(6) In the printing apparatus 11, since it is possible to integrally move the feeding motor 48 and the first pulley 122 using the movement mechanism, it is possible to easily adjust a tensile force of the belt 140, compared to a case in which a tensile force of the belt 140 is adjusted by separately moving the feeding motor 48 and the first pulley 122.

(7) In the printing apparatus 11, all of the components in the transmission unit 100 on the upstream side of the first pulley 122 are supported by the upstream side support unit 154. For this reason, it is possible to save time for separately adjusting positions of components on the downstream side of the second pulley 131 other than the feeding motor 48, when adjusting a tensile force of the belt 140 using the movement mechanism.

(8) Since the control unit 190 according to the embodiment controls the feeding motor 48 based on a rotation angle of the feeding motor 48, it is not easy to detect a fluctuation in the tensile force of the medium M due to backlash of the transmission unit 100 on the downstream side of the feeding motor 48 on the transmission path of a driving force. Accordingly, there is a concern that a control performance for controlling adjustment of a tensile force of the medium M by the control unit 190 (refer to FIG. 2) may deteriorate. Since the transmission unit 100 in the embodiment can further reduce backlash than the transmission unit 200 in the comparison example, it is possible to prevent a control performance of adjusting a tensile force of the medium M from deteriorating, even in a configuration in which the feeding motor 48 is controlled based on a rotation angle of the feeding motor 48.

In addition, the above-described embodiment may be changed as follows.

In the printing apparatus 11 according to the embodiment, at least any one of the first transmission mechanism 101 and the second transmission mechanism 102 may be a belt transmission mechanism which transmits a driving force using a belt. In this case, the third transmission mechanism 103 may be a toothed gear transmission mechanism which transmits a driving force using a toothed gear. In brief, when it is a configuration in which at least one of the plurality of transmission mechanisms 101, 102, and 103 includes the belt transmission mechanism, it is possible to reduce a fluctuation in a tensile force of the medium M compared to the printing apparatus in the comparison example in which all of the transmission mechanisms 101, 102, and 103 are formed of the toothed gear transmission mechanism.

In the printing apparatus 11 according to the embodiment, it is also possible to omit the second transmission mechanism 102. In this case, it is possible to omit the first rotating body 110, and cause the toothed gear 48*b* of the output shaft 48*a* to engage with the toothed gear 121 of the second rotating body 120. In addition, it is also possible to provide four or more transmission mechanisms in the transmission unit 100.

In the transmission unit 100 according to the embodiment, at least one of the plurality of transmission mechanisms 101, 102, and 103 may be a speed increasing mechanism in which the rotational speed which is input is larger than the rotational speed which is output, or a mechanism with a uniform speed in which the rotational speed which is input is the same as the rotational speed which is output.

In the transmission unit 100 according to the embodiment, the moderation ratio of at least one of the first transmission mechanism 101 and the second transmission mechanism 102 may be larger than that of the third transmission mechanism 103. In this case, it is preferable to set a transmission mechanism with the highest moderation ratio as the belt transmission mechanism.

In the third transmission mechanism 103 according to the embodiment, the belt 140 may be a flat belt. In this case, it is also possible to preferably suppress a fluctuation in the tensile force of the medium M, for example, by setting the friction between the belt 140 and the first pulley 122 and the second pulley 131 to be large, and setting the belt 140 so as not to slide with respect to the first pulley 122 and the second pulley 131.

In the third transmission mechanism 103 according to the embodiment, the belt 140 may be a chain belt, and the first pulley 122 and the second pulley 131 may be a sprocket wheel.

In the tensile force adjusting mechanism 160 according to the embodiment, it is also possible to cause the long holes 153*a* to incline toward the vertical direction Z.

In the feeding unit 40 according to the embodiment, it is also possible to include a tensile force adjusting mechanism which includes a tension roller. The tension roller is disposed inside the belt 140, and is in contact with the belt 140. A user adjusts the tensile force of the belt 140 by moving the tension roller.

In the feeding unit 40 according to the embodiment, a rotary encoder which detects a rotation angle of the medium support unit 45 may be provided, and the control unit 190 may control the feeding motor 48 in accordance with an output of the rotary encoder. Also in this case, it is possible to suppress deterioration in the control performance for controlling the tensile force of the medium M, since it is possible to reduce backlash of the transmission unit 100, compared to a feeding unit which includes a transmission unit in which all of the transmission mechanisms are toothed gear transmission mechanisms.

The printing apparatus 11 according to the embodiment may be changed to a so-called full-line type printing apparatus in which the printing unit 70 does not include the carriage 72, and includes a long fixed printing head which corresponds to the entire width of a medium M. In the printing head in this case, a printing range may stretch over the entire width of a medium M, by disposing a plurality of unit head portions in which nozzles are formed in line, and a printing range may be set so as to extend over the entire width of the medium M, by disposing many nozzles in a single long head so as to extend over the entire width of the medium M.

In the printing apparatus 11 according to the embodiment, a recording material which is used in printing may be a fluid body other than ink (including liquid, or liquid body which is obtained by dispersing or mixing particles of functional material in a liquid, a fluid body such as a gel, or a solid body which can be made to flow and ejected as a fluid). For example, it may be a configuration in which recording is performed by ejecting a liquid body containing a material such as an electrode material which is used when manufacturing, for example, a liquid crystal display, an EL (electroluminescence) display, a surface emission display, or the like, or a color material (pixel material) in the form of a dispersion or dissolution.

In addition, the printing apparatus may be a fluid body ejecting apparatus which ejects a fluid body such as a gel (for example, a physical gel), or a particulate object ejecting apparatus which ejects a solid body, for example, powder (particulate object) such as toner (for example, toner ejecting recording apparatus). In addition, the "fluid body" in the specification is a concept that does not include a fluid body which is formed of only a gas, and for example, a liquid (including an inorganic solvent, an organic solvent, a solution, a liquid resin, a liquid metal (metallic melt)), a liquid body, a fluid body, a particulate object (including particle object, powder), and the like, may be the fluid body.

The printing apparatus 11 is not limited to a printer which performs recording by ejecting a fluid body such as ink, and may be, for example, a non-impact printer such as a laser printer, an LED printer, or a thermal transfer printer (including dye sublimation printer), or may be an impact printer such as a dot impact printer. In addition, a medium M is not limited to a sheet, and may be cloth which is used in a plastic film, a textile printing apparatus, or the like.

This application claims priority under 35 U.S.C. §119 to Japanese Patent Application No. 2015-204853, filed Oct. 16 2015. The entire disclosure of Japanese Patent Application No. 2015-204853 is hereby incorporated herein by reference.

What is claimed is:

1. A printing apparatus comprising:

a feeding unit which includes a medium support unit which supports a roll-shaped medium, a driving unit which rotates the medium support unit, and a transmission unit which transmits a driving force of the driving unit to the medium support unit;

a transport unit which transports a medium fed from the feeding unit; and a control unit which adjusts a tensile force of the medium between the medium support unit and the transport unit, by controlling the driving unit, wherein the transmission unit includes a plurality of transmission mechanisms, and wherein the plurality of transmission mechanisms include a belt transmission mechanism which transmits the driving force using a belt.

2. The printing apparatus according to claim 1, wherein the transmission mechanism that is most downstream among the plurality of transmission mechanisms on a transmission path of the driving force is the belt transmission mechanism.

3. The printing apparatus according to claim 1, wherein the transmission mechanism with the highest moderation ratio among the plurality of transmission mechanisms is the belt transmission mechanism.

4. The printing apparatus according to claim 1, wherein the plurality of transmission mechanisms include a toothed gear transmission mechanism which transmits the driving force using a toothed gear.

5. The printing apparatus according to claim 1, wherein the feeding unit includes a tensile force adjusting mechanism for adjusting a tensile force of the belt.

6. The printing apparatus according to claim 5, wherein the belt transmission mechanism includes a first pulley and a second pulley around which the belt is wound, wherein the first pulley is disposed on an upstream side of the second pulley on a transmission path of the driving force, and wherein the tensile force adjusting mechanism is provided with an upstream side support unit which supports the driving unit and the first pulley, and a movement mechanism for moving the upstream side support unit with respect to the second pulley.

* * * * *